United States Patent [19]

Bertsch et al.

[11] Patent Number: 4,848,382

[45] Date of Patent: Jul. 18, 1989

[54] TUB BOTTOM SOIL SEPARATOR FOR DISHWASHER

[75] Inventors: Roger J. Bertsch, Lincoln Township, Berrien County; Wilbur W. Jarvis; Geoffrey L. Dingler, both of St. Joseph Township, Berrien County, all of Mich.

[73] Assignee: Whirlpool Corporation, Benton Harbor, Mich.

[21] Appl. No.: 112,099

[22] Filed: Oct. 22, 1987

[51] Int. Cl.[4] ..... B08B 13/00

[52] U.S. Cl. ..... 134/111; 134/182; 134/200; 210/532.1; 210/411

[58] Field of Search ..... 134/104, 111, 182, 200, 134/110, 111; 210/532.1, 112, 117, 136, 411

[56] References Cited

U.S. PATENT DOCUMENTS

| | | | |
|---|---|---|---|
| 1,853,589 | 4/1932 | Walker . | |
| 2,681,658 | 6/1954 | Meeker et al. | 134/111 |
| 3,103,225 | 9/1963 | Schmitt-Matzen | 134/111 X |
| 3,144,405 | 8/1964 | Beinke | 210/117 |
| 3,179,116 | 4/1965 | Jacobs | 134/111 X |
| 3,210,009 | 10/1965 | Long et al. | 134/111 X |
| 3,322,285 | 5/1967 | Lopp | 210/314 |
| 3,332,252 | 7/1967 | Zylstra | 134/111 |
| 3,335,867 | 8/1967 | Perl | 134/111 X |
| 3,807,419 | 4/1974 | Cushing et al. | 134/104 |
| 3,903,909 | 9/1975 | Noren et al. | 134/113 X |
| 4,243,431 | 1/1981 | Dingler et al. | 134/104 |
| 4,319,598 | 3/1982 | Dingler et al. | 134/57 |
| 4,346,723 | 8/1982 | Geiger | 134/104 |
| 4,347,861 | 9/1982 | Clearman et al. | 134/104 |
| 4,392,891 | 7/1983 | Meyers | 134/10 |
| 4,612,917 | 9/1986 | Duncan | 134/104 |
| 4,730,630 | 3/1988 | Ranfz | 134/111 |

*Primary Examiner*—Frankie L. Stinson

*Attorney, Agent, or Firm*—Jeffers, Hoffman & Niewyk

[57] ABSTRACT

A soil removal apparatus for a dishwashing machine including a stilling zone located in the sump of the dishwasher, and a receptacle located below the stilling zone for collecting and storing soil particles. The receptacle is also provided with a check valve and a second inlet as well as an outlet so that, upon operation of the dishwasher in the drain mode, drain water is routed through the receptacle for flushing soil particles from the receptacle to the outlet of the receptacle. During the draining operation, a check valve closes the first inlet of the receptacle.

15 Claims, 3 Drawing Sheets

TUB BOTTOM SOIL SEPARATOR FOR DISHWASHER

BACKGROUND OF THE INVENTION

This invention relates generally to dishwashing machines and in particular to a soil separator for a dishwashing machine which removes soil particles from the recirculating washing liquid in a dishwashing machine.

Conventional dishwashers, such as used in homes, include a tub defining a washing chamber, one or more racks mounted in the chamber for supporting dishes to be washed and a spray arm or other spray device from which water is sprayed on the dishes which are supported in the racks. The water, after being sprayed on the dishes is collected in a sump at the bottom of the chamber from which it is pumped to one or more spray arms by means of a recirculation pump. At the end of a washing cycle, a pump removes the waste water from the sump and delivers the water to the household sewage system.

A problem which has been encountered in such conventional dishwashers is that food soil particles which are washed from the dishes and which are suspended in the washing liquid are redeposited on the dishes during the washing process. The operational program of most such conventional dishwashers includes a drying operation which follows the washing operation. During the drying operation, heat is generally applied to the washed dishes whereby such redeposited soil particles are baked on the dishes, thereby making the soil particles difficult to remove.

It is therefore desired to provide an apparatus for removing soil particles from the dishwashing liquid in a diswashing machine so that only clean water is recirculated to the dishwasher spray arm.

Prior art dishwashing machines have provided various types of filtering devices for filtering soil from the recirculating washing liquid. U.S. Pat. No. 1,853,589, W. R. Walker, discloses a dishwashing machine having a sump portion in which soil accumulates during the dishwashing operation. A valve controls the discharge of the dishwashing liquid from the bottom of the sump upon completion of the dishwashing operation in order to remove the collected soil from the bottom of the sump at that time.

U.S. Pat. No. 3,322,285 discloses a filter for use in a dishwashing apparatus wherein the dishwashing liquid is passed through the filter to strain out the food particles. At the end of the dishwashing cycle, the filter is back-flushed to clean the filter and to flush the collected soil particles to the drain.

U.S. Pat. No. 3,807,419 discloses a dishwashing machine including a soil collecting receptacle located with its inlet above the normal level of the accumulated liquid in the dishwashing chamber, whereby the portion of recirculated washing liquid which flows down the back wall of apparatus is collected in the receptacle. Washing liquid collected in the receptacle overflows the receptacle and, as it does so, passes through a filter located in the path of the overflowing washing liquid whereby soil particles are trapped by the filter. The filter is washed by liquid impinging against it and the filtered out soil particles are collected in the receptacle. During the draining operation, the soil particles collected in the receptacle are flushed to the drain by routing washing liquid through the receptacle to the drain. A valving mechanism is provided whereby the washing liquid which flushes out the receptacle pressurizes the receptacle and closes the valve while opening a drain valve, thus permitting the washing liquid and collected soil particles to pass to the dishwasher drain.

U.S. Pat. No. 4,243,431 discloses a dishwashing machine including a by-pass passage wherein a portion of the recirculating water flows through a chamber whereby soil entrained in the bypassed liquid is separated. During the draining operation, the soil is flushed from the receptacle.

A problem with the prior art soil removal structures has been that soil is removed from only a portion of the recirculated dishwashing liquid. A further problem with the prior art dishwashers has been that the soil removal structure has been rather complicated and therefore expensive to manufacture. A still further problem with the prior art soil removal structure has been that many of these structures depend on the use of a filter which may become clogged with continuous use of the dishwashing machine.

It is therefore desired to provide a soil removal apparatus for a dishwashing machine which is simple, inexpensive to construct, and which can effectively remove soil from a substantial portion of the recirculated dishwashing liquid.

SUMMARY OF THE INVENTION

The present invention overcomes the disadvantages of the prior art soil removal structures by providing an improved soil removal apparatus therefrom.

The apparatus of the present invention, in one form thereof, includes a stilling zone in the sump of the dishwasher whereby the flow of dishwashing liquid in the stilling zone on its way to the drain aperture of the sump is non-turbulent. A receptacle is provided below the stilling zone whereby heavier-than-water soil particles will drop into the receptacle as the water flows over the receptacle inlet. At the end of the washing operation, the washing liquid is flushed through the receptacle to remove the soil particles from the dishwashing machine and is drained from the machine.

The present invention, in one form thereof, includes a perforated cover in the sump of a dishwasher thereby providing a stilling or non-turbulent zone below the cover. The stilling zone is provided with a drain aperture as well as a soil receptacle located adjacent the drain aperture for receiving heavier-than-water soil particles as the water flows over a first inlet of the receptacle toward the drain aperture. The first inlet of the receptacle is provided with a valve so that the first inlet may be closed off during the draining operation of the dishwasher. The receptacle is further provided with a second inlet and an outlet whereby, during the draining operation, washing liquid is routed through the second inlet to pressurize the receptacle, thereby closing the valve of the first inlet and permitting washing liquid to be flushed out of the outlet of the receptacle to the drain.

One advantage of the instant invention is that the soil receptacle is located in the sump of the machine whereby a substantial portion or even all of the washing liquid may be passed over the inlet of the receptacle to remove soil particles from substantially all of the recirculating washing liquid.

Another advantage of the present invention is that it is simple in construction and therefore relatively inexpensive to manufacture.

Still a further advantage of the present invention is that the apparatus effectively separates soil particles from dishwashing liquid.

The present invention, in one form thereof, provides a soil particle separator for a dishwashing machine including means for providing a low turbulence zone for dishwashing liquid collected in the sump. A receptacle is provided with a first inlet located below the low turbulence zone whereby soil particles will settle out of at least a portion of the washing liquid as the liquid flows toward the drain opening. The settled out soil particles will then enter into the first inlet of the receptacle. A second inlet and an outlet are also provided for the receptacle. Means are provided for pumping washing liquid from the drain opening into the second inlet of the receptacle upon completion of a washing operation. A valve is provided for the first inlet of the receptacle whereby soil particles collected in the receptacle may be removed from the receptacle by washing liquid which is pumped through the second inlet and the outlet of the receptacle.

The present invention, in one form thereof, comprises a soil separator for a dishwashing machine. The dishwashing machine includes a tub, a rack for supporting dishes within the tub, a spray arm for delivering washing liquid to dishes supported in the rack, a sump for collecting washing liquid from the dishes, a drain aperture in the sump and a pump for delivering washing liquid from the drain aperture to the spray arm. The sump is provided with a perforated cover. A receptacle including a first inlet is provided below the cover whereby the first inlet is below the flow path of at least a portion of the washing liquid which flows through the sump to the drain aperture and whereby soil particles will drop through the first inlet into the receptacle. A second inlet and an outlet are provided for the receptacle. A conduit is provided for delivering washing liquid from the drain aperture to the second inlet. A valve is provided for closing the first inlet of the receptacle, whereby washing liquid delivered to the second inlet will flush soil particles collected in the receptacle through the outlet.

The present invention, in one form thereof, further provides a soil separator apparatus for a dishwashing machine having a tub, a rack for supporting dishes in the tub, a spray arm for delivering washing liquid to the dishes supported in the rack, a sump for collecting washing liquid from the dishes, a drain aperture in the sump, and a pump for delivering washing liquid from the drain aperture to the spray arm. A soil separator apparatus includes a perforated cover for the sump, a receptacle having a first inlet located below the cover whereby the first inlet is below the flow path of at least a portion of the washing liquid which flows to the drain aperture. Soil particles will therefore settle out of the washing liquid and will enter the first inlet. The receptacle is also provided with an outlet and a second inlet. A conduit delivers washing liquid from the drain aperture to the second inlet. A check valve is operable to close the first inlet upon the flow of washing liquid through the second inlet, whereby soil particles collected in the receptacle are flushed from the receptacle by washing liquid which flows through the second inlet and the receptacle.

It is an object of the present invention to provide an effective soil removal apparatus for a dishwashing apparatus which is simple in construction and relatively inexpensive to construct.

It is a further object of the present invention to provide a soil removal apparatus for a dishwashing machine wherein a stilling zone and soil particle receptacle are provided to permit heavier than water soil particles to settle out of the dishwashing liquid for collection in the receptacle.

A yet further object of the present invention is to provide a dishwashing machine including a soil separator which operates without the use of a filtering device.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings wherein.

Corresponding reference characters represent corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figure 1:
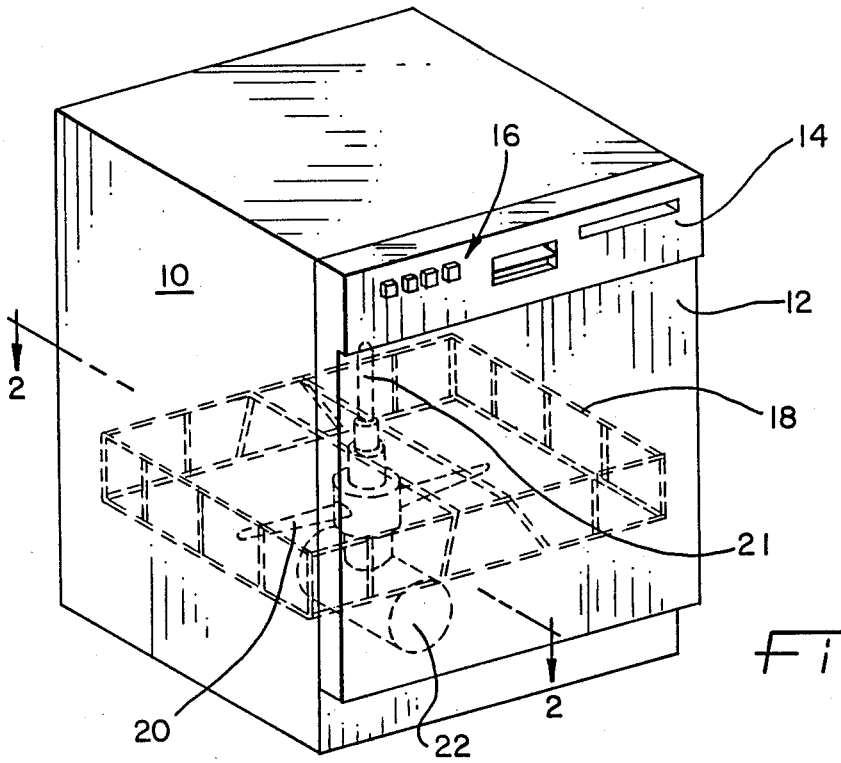
FIG. 1 is a perspective, fragmentary, view of a dishwashing machine including a soil removal apparatus according to the present invention.
Figure 2:
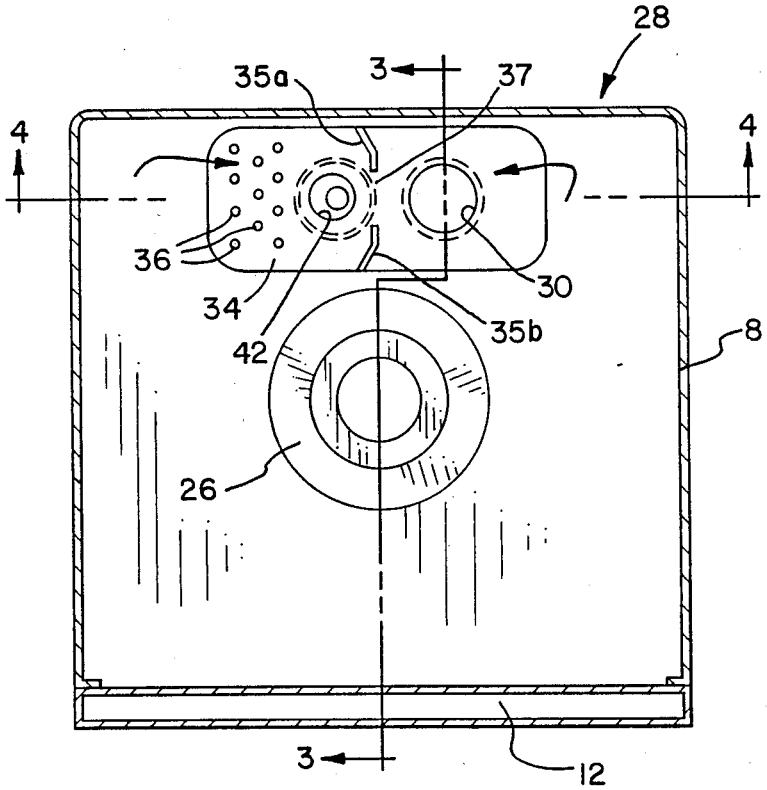
FIG. 2 is a cross sectional view of the tub bottom of the dishwasher of FIG. 1 taken along line 2—2.

Referring to FIGS. 1 and 2, there is shown a dishwashing apparatus including a dishwashing chamber 10 generally comprising a tub 8. Tub 8 may be constructed of either metal or plastic. A door 12 is provided to close the front of the enclosure. A console 14 houses a control 16 for controlling the operation of the dishwasher. A rack 18 is provided in chamber 10 for supporting dishes to be washed. A spray arm 20 is mounted on a column 21, as is conventional, for spraying dishwashing liquid such as water on the dishes, thereby cleaning the dishes. The dishwashing liquid is recirculated by a pump 22 mounted below the tub bottom, whereby dishwashing liquid is continually sprayed on the dishes, and thereafter collects in the tub bottom from whence it is recirculated by pump 22.

Figure 3:
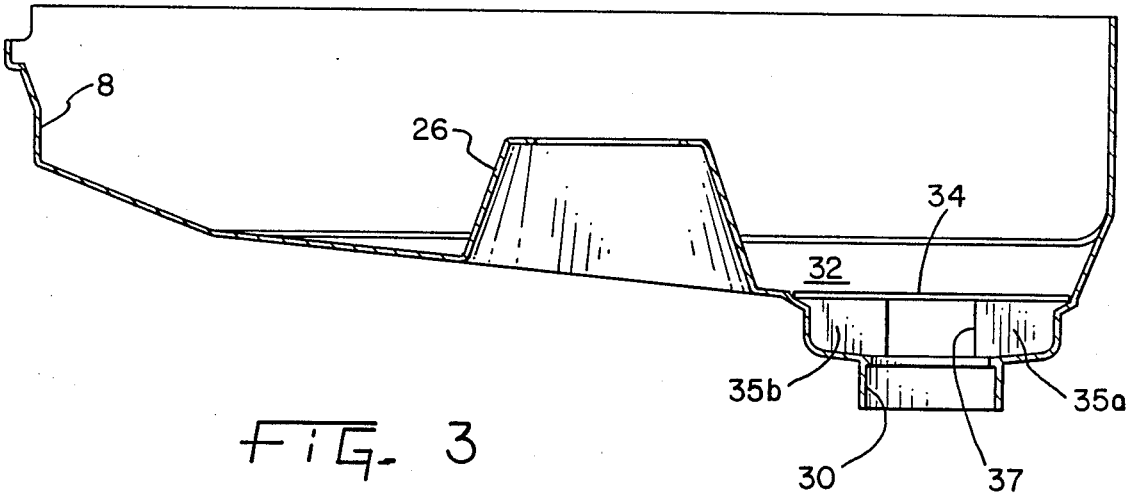
FIG. 3 is a cross sectional view of the tub bottom of the dishwasher including the drain thereof taken along line 3—3 of FIG. 2.

Referring now to FIGS. 2 and 3, the tub bottom provided with a soil removal apparatus 28 located at the rear of the dishwasher adjacent the back wall of dishwasher tub 8. It should be understood that the soil removal apparatus could be located in other areas of the dishwasher, such as the front or sides. Apparatus 28 is located in the sump 32 of the dishwasher. Sump 32 of the dishwasher is also provided with a drain aperture 30. A stilling zone 33 is provided by means of a cover 34 which covers a portion of the sump. The cover is provided with apertures 36 whereby water may enter stilling zone 33. By virtue of perforated cover 34, the water, after it enters zone 33, is no longer turbulent and the water flows gently along sloping wall 38 toward drain 30. It should be understood that, while perforations 36 have been shown for permitting water to enter stilling zone 33, different means can be provided for permitting water to enter the stilling zone. Thus, for instance, apertures might be provided between cover 34 and the bottom of tub 8, i.e. around the perimeter of cover 34, whereby water could flow into the stilling zone. For instance, a series of depressions could be provided in the plastic tub bottom 38 around the perimeter of cover 34, thereby creating apertures with cover 34 through which water could enter stilling zone 33.

A pair of upstanding walls 35A, 35B, are provided to further reduce turbulence in stilling zone 33. The walls do not meet but are separated by an opening 37. Cover 34 rests on the top of walls 35A and 35B. Thus, turbulence in and around drain aperture 30 will not cause turbulence in stilling zone 33 because the walls 35A and 35B isolate stilling zone 33 from drain aperture 30. Thus water which enters stilling zone 33 flows to drain aperture 30 through restricted opening 37.

A receptacle 40 is provided below the stilling zone 33. The receptacle 40 includes an inlet 42 over which water flows as shown by the arrows in FIG. 4A. Receptacle 40 includes an inlet 42 which is also provided with a valve 44 whereby inlet 42 may be closed. Valve, 44 in the disclosed embodiment, comprises a check valve including a valve actuator 45 as further described hereinafter. Receptacle 40 also includes a second inlet 46 and an outlet 48 which is also provided with a check valve 50.

Figure 4A:
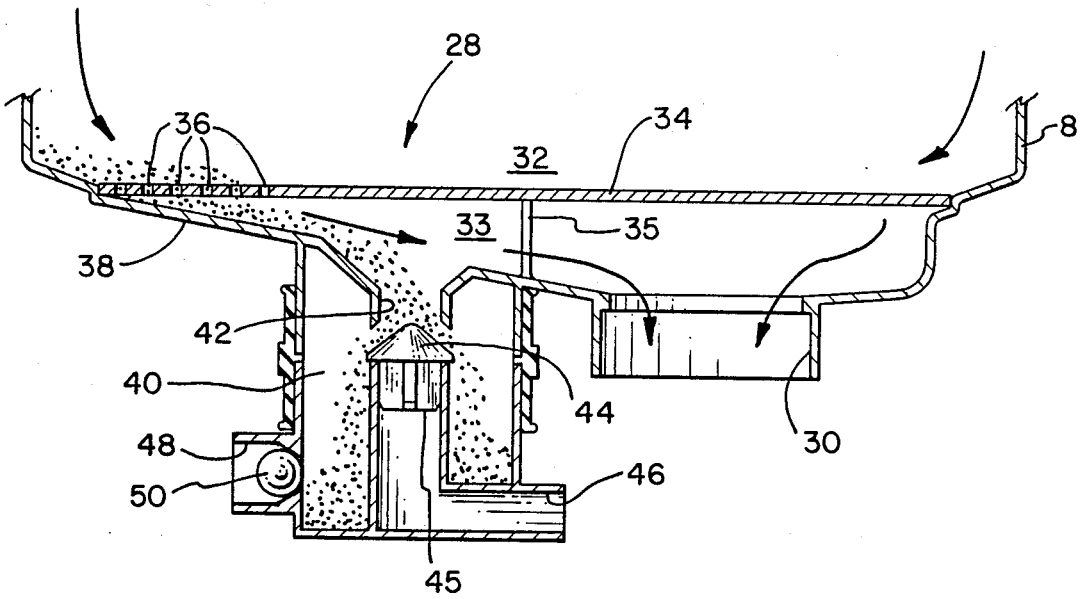
FIG. 4 is a cross sectional view of the soil removal apparatus, according to the present invention, during the collecting mode of the apparatus and taken along line 4—4 of FIG. 2.
FIG. 4B is a cross sectional view of the soil removal apparatus, according to the present invention during the flushing mode of the apparatus, and taken along line 4—4 of FIG. 2.

In operation, the apparatus functions as follows. During normal operation as shown in FIG. 4A, i.e. during a dishwashing operation, water will be continuously drawn by pump 22 through drain aperture 30 and is then sprayed on the dishes by revolving spray arm 20. Water will run downwardly from the dishes and the side walls of the tub 8 into sump 32. The water will then flow through apertures 36 into stilling zone 33 and then back to drain 30.

If large chunks of soil are washed off the dishes, they will be retained on the top of cover 34 as apertures 36 in the cover are relatively small. If any large soil particles have collected on cover 34, cover 34 may be removed for cleaning. However, small particles of soil entrained in the water will be able to enter stilling zone 33 with the recirculating dishwater through apertures 36 and will flow with the gently flowing water in the stilling zone 33 over inlet 42 of receptacle 40. Since these soil particles are heavier than water, and since the flow of water in stilling zone 33 is non turbulent, the particles passing over inlet 42 will drop into receptacle 40 wherein they are temporarily stored.

In the disclosed embodiment, inlet 42 and receptacle 40 are located so that only a portion of the recirculating water flows over inlet 42. However, it should be understood that different arrangements for locating receptacle 40 and inlet 42 may be provided so that the major portion of the dishwashing liquid, if not all o the dishwashing liquid, is passed over receptacle 40. Thus, for instance, several inlets could be provided for receptacle 40 in the different areas of stilling zone 33 so that effectively all of the recirculating water is passed over receptacle 40.

Figure 4B:
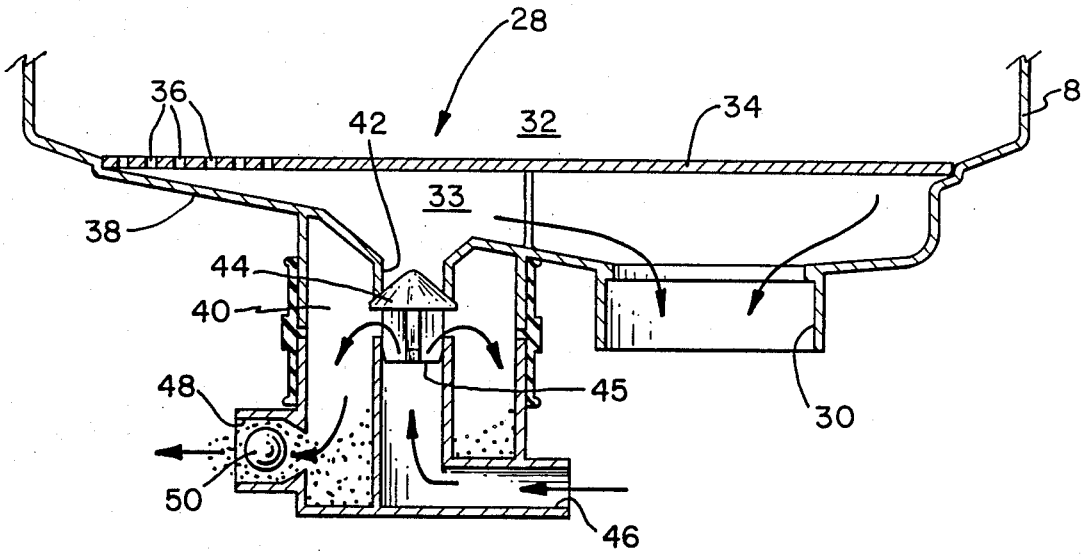

Referring now to FIG. 4B, the apparatus is shown in the drain mode. After a dishwashing operation has been completed, the pump performs a draining operation for the dishwasher, as is conventional. The outlet of the pump in the drain mode is connected to inlet 46 of receptacle 40. Thus water will flow through inlet 46, as shown, thereby forcing valve actuator 45 upwardly and causing valve 44 to close inlet 42. Thus drain water will flow through receptacle 40 and will cause check valve 50 to open, thereby flushing the soil particles stored in receptacle 40 out of outlet 48. Outlet 48 is connected to the house sewage system, whereby the soil particles are removed from the dishwasher.

Thus, an apparatus has been disclosed for effectively removing soil from recirculating dishwashing liquid and which is relatively inexpensive to construct.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. In a dishwashing machine includng a washing chamber, a sump for collecting washing liquid, a drain aperture in said sump for draining washing liquid from said sump, a pump connected to said drain aperture and adapted to circular washing liquid collected in said sump, soil removal apparatus for removing soil from said recirculating washing liquid comprising:

perforated cover means providing a low turbulence zone for said washing liquid in the flow path of the washing liquid through said sump on an outlet side of said cover means;

a receptacle including a first inlet therefor, said first inlet located in said low turbulence zone whereby soil particles will settle out of at least a portion of the washing liquid flowing toward said drain opening and will enter said receptacle through first inlet;

a second inlet for said receptacle;

an outlet for said receptacle;

means for pumping washing liquid from said drain opening into said second inlet; and valve means for selectively closing said first inlet whereby soil collected in said receptacle may be removed from said receptacle by washing liquid which is directed through said second inlet and said outlet of said receptacle.

2. The invention according to claim 1 wherein said inlet for said receptacle is located adjacent said drain aperture.

3. The invention according to claim 1 wherein said valve means comprises a valve which closes in response to washing liquid entering said receptacle through said second inlet.

4. The invention according to claim 3 wherein said valve comprises a check valve.

5. The invention according to claim 1 wherein said means for providing a low turbulence area comprises a perforated cover for said sump.

6. The invention according to claim 1 wherein said sump is located adjacent the rear wall of said washing chamber.

7. In a dishwashing machine including a tub, a rack for supporting dishes within said tub, a spray arm for delivering washing liquid to dishes supported in said rack, a sump for collecting washing liquid from said dishes, a drain aperture in said sump, a pump for delivering washing liquid from said drain aperture to said spray arm, a soil separator apparatus comprising:

a perforated cover in the flow path of the washing liquid for forming a low turbulence zone in said sump on an outlet side of said cover;

a receptacle having a first inlet located below said cover on the outlet side thereof whereby said first inlet is in the flow path of at least a portion of the washing liquid which flows through said sump to said drain aperture and whereby soil particles will settle out of said flowing liquid and drop through said first inlet into said receptacle;

an outlet for said receptacle;

a second inlet for said receptacle;

means for delivering washing liquid from said drain aperture in said second inlet; and a valve for closing said first inlet, whereby washing liquid delivered to said second inlet will flush soil particles which have collected in said receptacle through said outlet.

8. The invention according to claim 7 wherein said inlet for said receptacle is located adjacent said drain aperture.

9. The invention according to claim 7 wherein said valve closes in response to washing liquid flowing into said second inlet.

10. The invention according to claim 9 wherein said valve comprises a check valve.

11. The invention according to claim 7 wherein said cover is perforated.

12. The invention according to claim 7 wherein said sump is located adjacent the rear wall of said tub.

13. In a dishwashing machine including a tub, a rack for supporting dishes in said tub, a spray arm for delivering washing liquid to the dishes supported in said rack, a sump for collecting washing liquid from said dishes, a drain aperture in said sump, a pump for delivering washing liquid from said drain aperture to said spray arm, a soil separator apparatus comprising;

a perforated cover in the flow path of the washing liqquid for forming a low turbulence zone in said sump on an outlet side of said cover;

a receptacle having a first inlet located below said cover on the outlet side thereof whereby said first inlet is in the flow path of at least a portion of the washing liquid which flows to said drain aperture and whereby soil particles will settle out of said washing liquid and enter said first inelt;

an outlet for said receptacle;

a second inlet for said receptacle;

means for delivering washing liquid from said drain aperture to said second inlet; and a check valve operable to close said first inlet in response to the flow of washing liquid through said second inlet, whereby collected soil particles in said receptacle are flushed from said receptacle by washing liquid flowing through said second inlet and said receptacle.

14. The invention according to claim 13 wherein said inlet for said receptacle is located adjacent said drain aperture.

15. The invention according to claim 13 wherein said sump is located adjacent the rear wall of said tub.

* * * * *